United States Patent [19]

Matsui et al.

[11] Patent Number: 4,638,785

[45] Date of Patent: Jan. 27, 1987

[54] IGNITION SYSTEM FOR INTERNAL COMBUSTION ENGINES

[75] Inventors: Takeshi Matsui, Toyohashi; Shunichi Takeda, Obu; Tomoatsu Makino, Okazaki, all of Japan

[73] Assignee: Nippondenso Co., Ltd., Kariya, Japan

[21] Appl. No.: 827,167

[22] Filed: Feb. 7, 1986

[30] Foreign Application Priority Data

Feb. 11, 1985 [JP] Japan ..... 60-24993

[51] Int. Cl.[4] ..... F02P 5/08

[52] U.S. Cl. ..... 123/644; 123/427; 123/418; 123/415; 123/406

[58] Field of Search ..... 123/427, 644, 418, 415, 123/406

[56] References Cited

U.S. PATENT DOCUMENTS

| | | | |
|---|---|---|---|
| 4,307,691 | 12/1981 | Nagae et al. | 123/427 |
| 4,373,488 | 2/1983 | Neubalfen | 123/427 |
| 4,380,989 | 4/1983 | Takaki | 123/644 |
| 4,440,130 | 4/1984 | Taguchi et al. | 123/427 |
| 4,467,776 | 8/1984 | Mezger et al. | 123/644 |
| 4,473,050 | 9/1984 | Kondo et al. | 123/427 |

*Primary Examiner*—Raymond A. Nelli

*Attorney, Agent, or Firm*—Cushman, Darby & Cushman

[57] ABSTRACT

An ignition system for an internal combustion engine is disclosed. The ignition system includes a timing signal detector responsive to the rotation speed of an engine to generate a pulse signal including a leading edge and a trailing edge corresponding to the ignition timing and having a predetermined duty cycle, a triangular wave generator for generating a triangular wave voltage synchronized with the trailing edge of the pulse signal, a voltage storing circuit for storing the voltage level of the triangular wave voltage in synchronism with the leading edge of the pulse signal, a voltage divider for dividing the stored voltage in the voltage storing circuit to generate a reference voltage, a comparator for comparing the reference voltage and the triangular wave voltage to detect a difference therebetween, a charging and discharging controller for correcting the stored voltage in the voltage storing circuit so as to reduce to zero the difference at the leading edge of the pulse signal, a threshold voltage generator for generating a threshold voltage which is offset from the stored voltage by an amount corresponding to the desired dwell time of an ignition coil, and an energization controller for controlling the dwell time of the ignition coil in accordance with the result of a comparison between the threshold voltage and the triangular wave voltage.

12 Claims, 5 Drawing Figures

IGNITION SYSTEM FOR INTERNAL COMBUSTION ENGINES

BACKGROUND OF THE INVENTION

1. Field of the Invention

The present invention relates to an ignition system for internal combustion engines.

2. Description of the Related Art

A conventional ignition system for internal combustion engines is disclosed in U.S. Pat. No. 4,440,130. This ignition system includes a timing signal detector for generating a pulse signal having a pulse spacing corresponding to the rotation speed of the engine, voltage storing means for storing a voltage corresponding to the rotation speed of the engine, and sawtooth wave generating means for generating a sawtooth wave having a period corresponding to that of the pulse signal and having a slope corresponding to the stored voltage in the voltage storing means. This ignition system compares the voltage level of the sawtooth wave generated from the sawtooth wave generating means with a reference voltage for every period of pulse signals generated from the timing signal generator, so that when there is a deviation or difference between the two voltages, the voltage level of the stored voltage stored in the voltage storing means is varied according to the difference and the slope of the sawtooth wave is varied thus rapidly producing an accurate stored voltage corresponding to the rotation speed and thereby accurately performing a duty cycle control for controlling the dwell time of the ignition coil.

However, since this conventional ignition system corrects the stored voltage in the voltage storing means thus controlling the next dwell time of the ignition coil, when the rotation speed of the engine increases rapidly, the then current dwell time of the ignition coil must be maintained for a given period of time. Also, since the slope of the sawtooth wave voltage is varied when the stored voltage is varied and since the sawtooth wave voltage is discharged within the duration time of the pulse signal, the minimum value of the ignition coil dwell time becomes the duration time of the pulse signal. On account of these reasons, the conventional ignition system is disadvantageous in that during the steady-state operation of the engine the dwell time of the ignition coil must be increased thus increasing the heat generation of the ignition coil. Another disadvantage is that while the pulse width of the pulse signal must preliminarily be decreased so as to reduce the heat generation of the ignition coil, if the pulse width is decreased to an extent that any excessive heat generation of the ignition coil is prevented, when rapidly increasing the rotation speed of the engine, the then current dwell time of the ignition coil becomes insufficient thus causing the engine to misfire.

SUMMARY OF THE INVENTION

It is an object of the present invention to provide an ignition system for an internal combustion engine including a timing signal detector responsive to the rotation speed of an engine to generate a pulse signal including a leading egde and a trailing edge corresponding to the ignition timing and having a given duty cycle, a triangular wave generator for generating a triangular wave voltage synchronized with the trailing egde of the pulse signal, a voltage storing circuit for storing the voltage level of the triangular wave voltage in synchronism with the leading edge of the pulse signal, a voltage divider for dividing the stored voltage in the voltage storing circuit to generate a reference voltage, comparing means for comparing the reference voltage and the triangular wave voltage for detecting the deviation or difference between the voltages, a charging and discharging controller for correcting the stored voltage in the voltage storing circuit to reduce to zero the difference at the leading edge of the pulse signal, a threshold voltage generator for generating a threshold voltage offset from the stored voltage by an amount corresponding to the desired dwell time of the ignition coil, and an energization controller for controlling the dwell time of the ignition coil in accordance with the result of a comparison between the threshold voltage and the triangular wave voltage.

In accordance with the present invention, a triangular wave voltage generated in synchronism with a pulse signal generated in response to the rotation speed of an engine is compared with a reference voltage generated by dividing the voltge level of the triangular wave voltage stored in a voltage storing circuit in synchronism with the pulse signal whereby the voltage level (the stored voltage) in the voltage storing circuit is corrected thus reducing to zero the difference voltage between the two voltages and thereby generating a voltage corresponding to the peak voltage of the triangular wave voltage and a threshold voltage offset from this voltage by an amount corresponding to the desired dwell time of the ignition coil is compared with the triangular wave voltage thus determining ON period of the ignition coil. Thus, the ON period of the ignition coil can be maintained substantially constant even though the rotation speed of the engine is increased.

In accordance with the present invention, there is a great effect that the proper ON period of the ignition coil is always obtained with the result that the occurrence of engine misfiring due to any insufficient ON period is prevented and also any excessive heat generation of the ignition coil is prevented.

DESCRIPTION OF THE PREFERRED EMBODIMENTS

Figure 1:
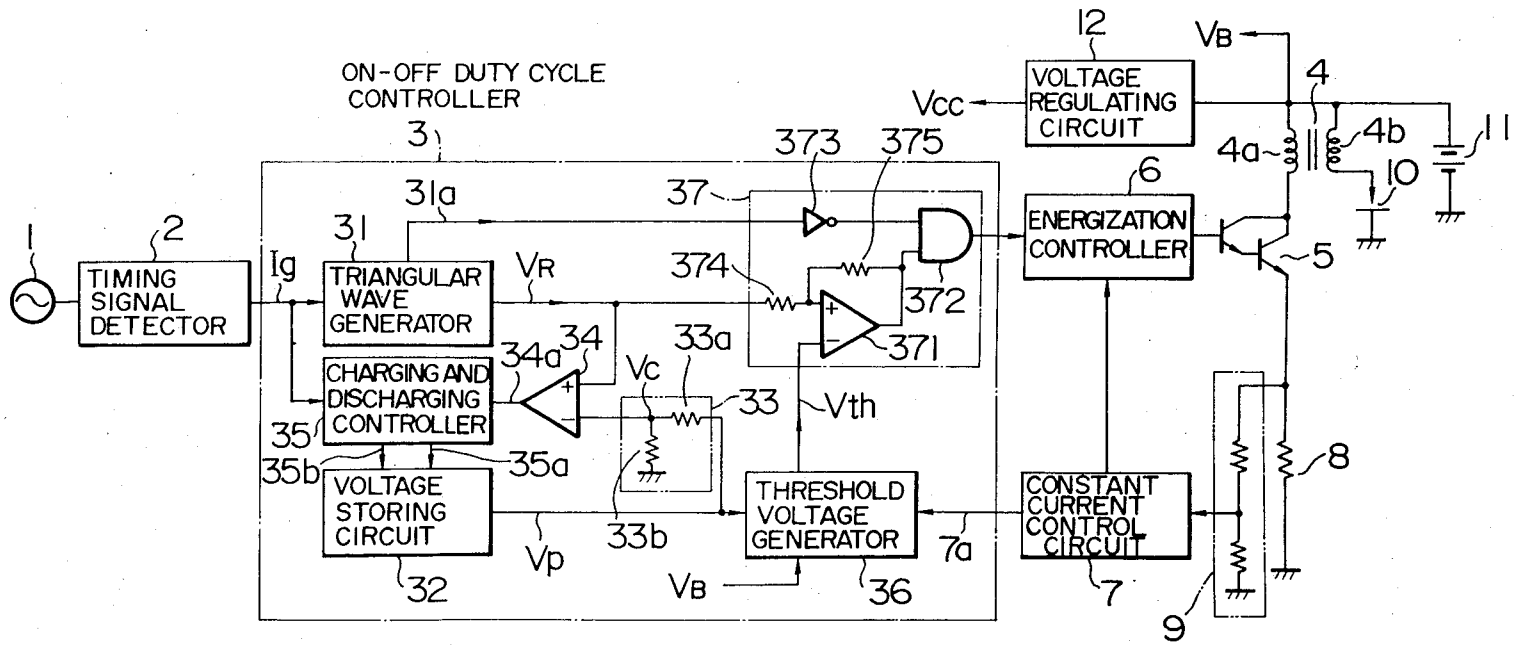
FIG. 1 is a circuit diagram showing an embodiment of an ignition system according to the invention.

The present invention will now be described with reference to the illustrated embodiment. In FIG. 1 showing a block diagram of the ignition system of an engine, numeral 1 designates an input signal generator for determining the timing of ignition. The signal generator 1 supplies an input signal (speed signal) generated from its magnet pickup coil, for example, in synchronism with the engine crankshaft to a timing signal detector 2. The timing signal detector 2 reshapes the input signal from the signal generator 1 to generate a pulse signal Ig. As shown in (a) of FIG. 4, the pulse signal Ig generates a high level state with a given duty cycle and the pulse signal (high level) has a leading edge hereinafter refered to as a rising edge and a trailing edge hereinafter refered to as a falling edge synchronized with the ignition timing of the engine. Then, the pulse signal Ig from the timing signal detector 2 is supplied to an ON/-OFF duty cycle controller 3. The controller 3 generates a signal for determining the duty cycle of the ON and OFF periods of transistor 5 and supplies it to an energization controller 6. The output terminal of the energization controller 6 is connected to a base of the transistor 5 to control its switching operation. A collector of the transistor 5 is connected to a primary winding 4*a* of an ignition coil 4 and its emitter is grounded through a resistor 8. A constant current control circuit 7 detects the current flow in the ignition coil 4 through the resistor 8 and a voltage divider 9 to limit the collector current of the transistor 5 to a given value and it also feeds back to the duty cycle controller 3 a signal 7*a* which is used for the control of the following section. Numeral 10 designates a spark plug connected to a secondary winding 4*b* of the ignition coil 4, 11 a power source, and 12 a voltage regulating curcuit for supplying a stabilized voltage $V_{CC}$ to the ignition system.

Figure 4:
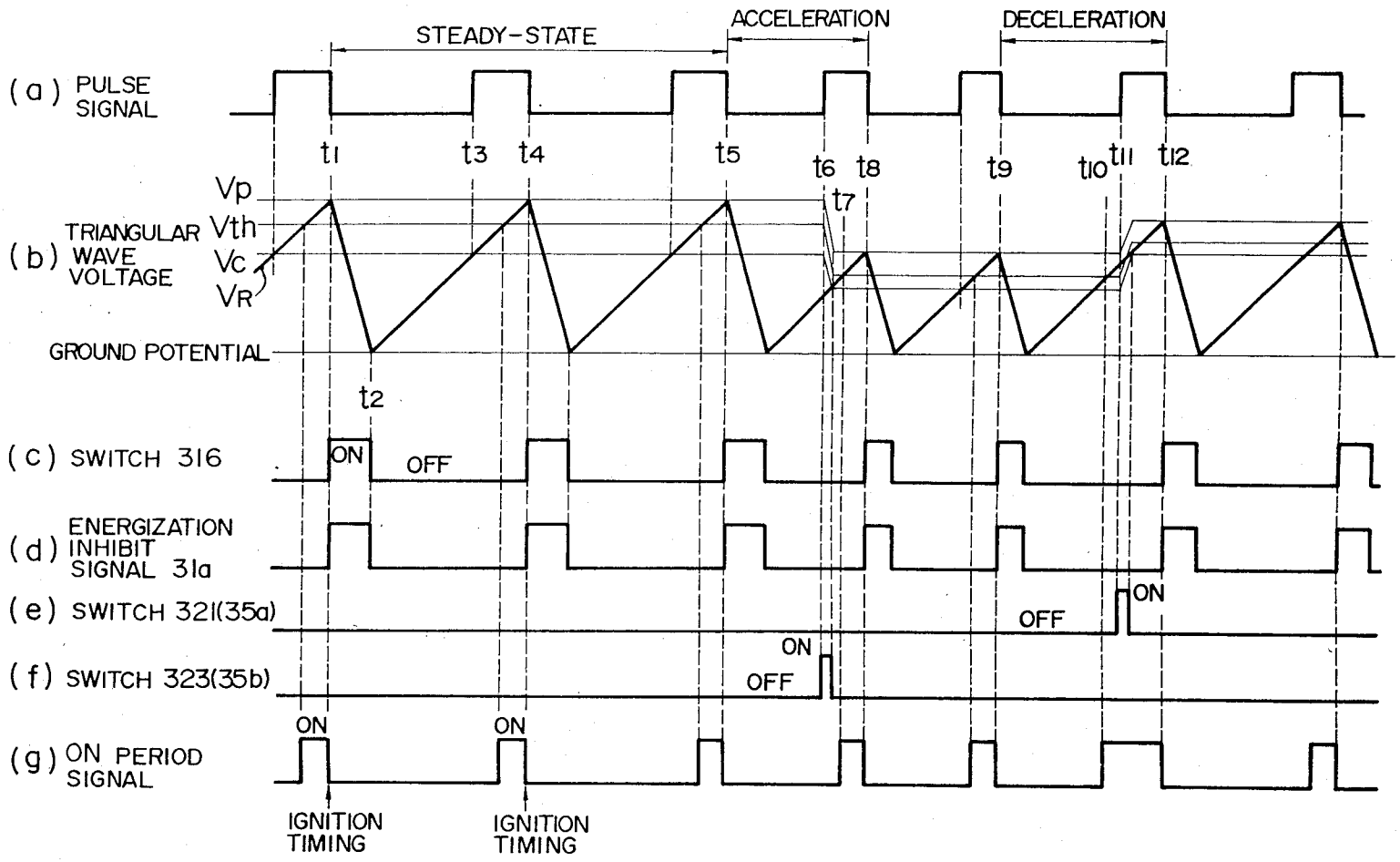
FIG. 4 is a timing chart for explaining the operation of the circuitry of the ignition system of FIG. 1 at low engine speeds.

The ON/OFF duty cycle controller 3 will now be described. The pulse signal Ig gnerated from the timing signal detector 2 as shown in (a) of FIG. 4 is supplied to a triangular wave generator 31 and a charging and discharging controller 35.

Figure 2:
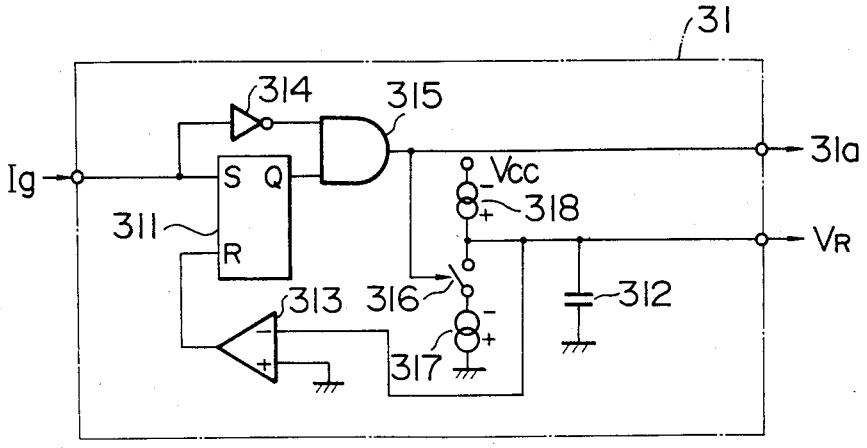
FIG. 2 is a detailed circuit diagram of the triangular wave generator in the ignition system of FIG. 1.

FIG. 2 shows a detailed construction of the triangular wave generator 31. Numeral 311 designates an R-S flip-flop whose set terminal S is supplied with the pulse signal Ig. The R-S flip-flop 311 has its reset terminal R connected to the output of a comparator 313. The comparator 313 is supplied at its inverting input terminal with the triangular wave voltage $V_R$ stored in a triangular wave generating capacitor 312 and its noninverting input terminal is supplied with the ground potential. Numeral 315 designates an AND gate which receives the pulse signal Ig through the output terminal Q of the R-S flip-flop 311 and an inverter 314, respectively. Then, the output signal of the AND gate 315 is used as an ON/OFF signal for an analog switch 316 and an energization inhibit signal 31a as shown respectively in (c) and (d) of FIG. 4.

Numerals 317 and 318 designate first and second constant current sources. The first current source 317 has its positive terminal grounded and its negative terminal connected to the nongrounded terminal of the triangular wave capacitor 312 through an analog switch 316. The first current source 317 functions so that the stored charge in the triangular wave capacitor 312 is discharged when the analog switch 316 is turned on. The second current source 318 has its one end (positive terminal) connected to the triangular wave capacitor 312 and its other end (negative terminal) connected to the internal power supply $V_{CC}$. Then, the second current source 318 functions so as to always charge the capacitor 312. In the present embodiment, the current ratio between the first and second current sources 317 and 318 is selected for example 10:1 so that the slope of the terminal voltage of the triangular wave capacitor 312 or the triangular wave voltage $V_R$ during its charging is 1/9 of that during its discharging. With the described construction of the triangular wave generator 31, at the time of the falling edge of the pulse signal Ig shown as a time $t_1$ in (a) of FIG. 4, the R-S filp-flop 311 is set and its output terminal Q maintains a high level.

During the time interval from $t_1$ to $t_2$, the pulse signal Ig goes to a low level and the output of the inverter 314 goes to the high level thus causing the output of the AND gate 315 to go to the high level. Then, the analog switch 316 is turned on as shown in (c) of FIG. 4, so that the charge in the triangular wave capacitor 312 is discharged by the first current source 317 and the triangular wave voltage $V_R$ decreases. At the time $t_2$, the triangular wave voltage $V_R$ becomes lower than the ground potential so that the output of the comparator 313 changes its state and the reset terminal of the R-S flip-flop 311 goes to the high level. Thus, the R-S flip-flop 311 is reset.

As the R-S flip-flop 311 stays in the reset state during the interval from the time $t_2$ to a time $t_3$ on the rising edge of the following pulse signal Ig, the output terminal Q maintains a low level. Accordingly, the output of the AND gate 315 goes to the low level.

Also, during the interval from the time $t_3$ to a time $t_4$ or the falling edge of the next ignition cycle the pulse signal Ig goes to the high level and the output of the invertor 314 goes to the low level thus causing the output of the AND gate 315 to go to the low level.

As a result, during the time interval from $t_2$ to $t_4$ the output of the AND gate 315 goes to the low level. After all during the time interval from $t_2$ to $t_4$ the analog switch 316 is turned off and the triangular wave capacitor 312 is charged by the second current source 318. As described hereinabove, the triangular wave capacitor 312 is charged and discharged repeatedly in synchronism with the falling edge of each pulse signal Ig to generate a triangular wave voltage $V_R$ having constant slopes of the charging and discharging characteristics.

Since the ratio of the currents in the first and second current sources 317 and 318 preset to a constant value (10:1 in this embodiment) as mentioned previously, the time ratio between the charging period and the discharging period is also constant and therefore the duty cycle of the energization inhibit signal 31*a* shown in (d) of FIG. 4 is also constant (1/10 in this embodiment). The energization inhibit signal 31*a* is applied to an AND gate 372 through an inverter 373 so that it serves as a gate signal for the output signal of a comparator 371 and the maximum duty cycle for the ON period of the transistor 5 is determined (9/10 in this embodiment). Then, during the time that the energization inhibit signal 31*a* is at the high level (during the time that the triangular wave voltage $V_R$ is discharged), the current flow to the power transistor 5 is interrupted so as to not impede the high voltage discharge at the spark plug 10.

Figure 3:
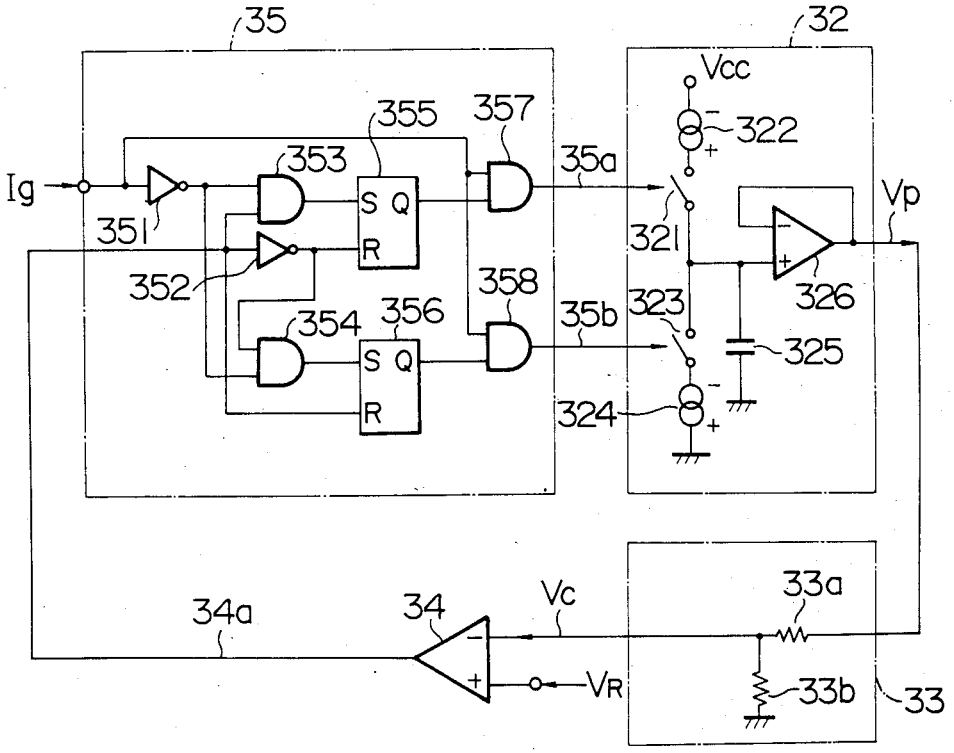
FIG. 3 is a circuit diagram showing in detail the charging and discharging controller and the voltage storing circuit in the ignition system of FIG. 1.

Referring now to FIG. 3, there are illustrated detailed constructions of a charging and discharging controller 35 and a voltage storing circuit 32 and they will be described in detail. The pulse signal Ig is applied to AND gates 357 and 358, respectively. Also, the pulse signal Ig is inverted by an inverter 351 and then appleid to AND gates 353 and 354, respectively.

The terminal voltage of a voltage storing capacitor 325 is applied to the noninverting input terminal of a voltage follower 326. Then, the output of the voltage follower 326 or the stored voltage $V_P$ is divided by a voltage divider 33 including resistors 33*a* and 33*b* and the resulting voltage $V_C$ is applied to the inverting input terminal of a comparator 34 whose noninverting input therminal receives the triangular wave voltage $V_R$. Then, the output of the comparator 34 or the reference signal 34a is applied to the AND gate 353 and the reset terminal R of an R-S flip-flop 356, respectively, and the reference signal 34a is also applied to the reset terminal R of an R-S flip-flop 355 and the AND gate 354 through an inverter 352. The output of the AND gates 353 and 354 are respectively applied to the set terminals S of the R-S flip-flops 355 and 356. The outputs Q of the R-S flip-flops 355 and 356 are respectively applied to the AND gates 357 and 358. The AND gates 357 and 358 generate respectively a charge control signal 35a and a discharge control signal 35b. A first analog switch 321 is responsive to the charge control signal 35a to switch on and off the current flow between a current source 322 and the voltage storing capacitor 325 with the timing shown in (e) of FIG. 4. The current source 322 functions so as to charge the voltage storing capacitor 325. A second analog switch 323 is responsive to the discharge control signal 35b to switch on and off the current flow between a current source 324 and the voltage storing capacitor 325 with the timing shown in (f) of FIG. 4. The current source 324 has its positive terminal grounded and it functions so as to discharge the voltage storing capacitor 325.

With the charging and discharging controller 35 and the voltage storing circuit 32 constructed as described above, during the time that the pulse signal Ig is at the low level, only one or the other of the flip-flops 355 and 356 is set in response to the state of the reference signal 34a. This state is held when the pulse signal Ig gose to the high level.

A threshold voltage generator 36 is responsive to a supply voltage $V_B$ and the feedback information signal 7a from the constant current control circuit 7 to generate the threshold voltage Vth shown in (b) of FIG. 4 and offset with respect to the stored voltage $V_P$ by an amount corresponding to the desired value for the constant current energization time of the power transistor 5.

An energization signal generator 37 includes the comparator 371 adapted to receive the threshold voltage Vth and the triangular wave voltage $V_R$ as its inverting and noninverting inputs, respectively, and having a hysteresis provided by resistors 374 and 375, and the AND gate 372 for receiving the output of the comparator 371 and the energization inhibit signal 31a through the inverter 373 and it generates, as an output of the AND gate 372, the signal shown in (g) of FIG. 4 for determining the duty cycle for the ON period of the transistor 5.

Now, if the reference voltage $V_C$ is higher than the triangular wave voltage $V_R$ at a time $t_6$ or the time of the leading edge of the pulse signal Ig shown in FIG. 4, the reference signal 34a goes to the low level. Then, since the pulse signal Ig is at the low level, the output of the AND gate 354 goes to the high level and the R-S flip-flop 356 is set. Then, after the leading edge time $t_6$ the pulse signal Ig goes to the high level and also the R-S flip-flop 356 is held causing the output of the AND gate 358 to go to the high level. Then, the second analog switch 323 is turned on and the charge in the voltage storing capacitor 325 is discharged. Thus, the stored voltage $V_P$ decreases. As the stored voltage $V_P$ *decreases so that the reference voltage* $V_C$ becomes slightly lower than the triangular wave voltage $V_R$, the comparator 34 changes its output state and the reference signal 34a goes to the high level. Then, the flip-flop 356 is reset and the second analog switch 323 is restored to its off position. When the switch 323 returns to the off position, the charge in the voltage storing capacitor 325 is no longer discharged and the stored voltage $V_P$ holds its value. Since the current value of the current source 324 is selected sufficiently large and the discharge of the voltage storing capacitor 325 is completed in a short period of time, after the completion of the discharge the value of the comparison voltage $V_C$ becomes substantially equal to the value of the triangular wave voltage $V_R$ at the time $t_6$.

Then, with the division ratio of the voltage divider 33 selected to assume a suitable value in relation to the duty cycle of the pulse signal Ig and the duty cycle of the analog switch 316 (in this embodiment the division ratio of the voltage divider 33 is selected 7/9 in correspondence to the duty cycle of 1/5 for the pulse signal Ig and the duty cycle of 1/10 for the switch 316), if the charge in the voltage storing capacitor 325 is charged and discharged so that the value of the reference voltage $V_C$ becomes equal to the triangular wave voltage $V_R$ at the rising edge of the pulse signal Ig, the stored voltage $V_P$ becomes equal to the peak voltage of the triangular wave voltage $V_R$ at the falling edge of the pulse signal Ig. In other words, immediately after the time $t_6$ the stored voltage attains an anticipated value of the triangular wave voltage $V_R$ at a time $t_8$.

Then, if the reference voltage $V_C$ is lower than the triangular wave voltage $V_R$ at a time $t_{10}$ of the pulse signal Ig, the reference signal 34a goes to the high level and the flip-flop 355 is set. After a rising edge time $t_{11}$, the logical product of the pulse signal Ig and the output of the flip-flop 355 is generated from the AND gate 357. Then, the first analog switch 321 is turned on so that the voltage storing capacitor 325 is charged from the current source 322 and the stored voltage $V_P$ rises. As the stored voltage $V_P$ rises so that the reference voltage $V_C$ becomes slightly higher than the triangular wave voltage $V_R$, the comparator 34 changes its output state. Thus, the reference signal 34a goes to the low level and the flip-flop 355 is reset thereby restoring the first analog 321 to the off position. When the first analog switch 321 returns to the off position, the voltage storing capacitor 325 is not charged any longer and the stored voltage $V_P$ holds an anticipated value for the peak value of the triangular wave voltage $V_R$.

With the construction described above, the operation of the present embodiment will now be described in greater detail. The timing chart of FIG. 4 shows the conditions during the low speed operation of the engine ranging from about 600 rpm (idling speed) to about 1200 rpm. Here the threshold voltage Vth is preset intermediary between the stored voltage $V_P$ and the reference voltage $V_C$. Also, the triangular wave voltage $V_R$ shown in (b) of FIG. 4 is repeatedly charged and discharged in synchronism with the trailing edge of each pulse signal Ig so that the energization inhibit signal 31a shown in (d) of FIG. 4 is generated from the triangular wave generator 31 in correspondence to each discharge period. The reference voltage $V_C$, shown in (b) of FIG. 4 along with the triangular wave voltage $V_R$, results from the division of the stroed voltage $V_P$ by the voltage divider 33 and the stored voltage $V_P$ in the voltage storage 32 is controlled so as to reduce the difference between the triangular wave voltage $V_R$ and the reference voltage $V_C$ to zero at the rising edge of the pulse signal Ig.

When the reference voltage $V_C$ and the triangular wave voltage $V_R$ attain the same voltage level at the time $t_3$, the then current stored voltage $V_P$ represents an anticipated value of the triangular wave voltage $V_R$ at the time $t_4$. The threshold voltage Vth is offset with respect to the stored voltage $V_P$ by an amount corresponding to the desired value of the constant current energization time of the power transistor 5. The threshold voltage Vth is generated from the threshold voltage generator 36. Also, the stored voltage $V_P$, the power supply voltage $V_B$ and the control signal 7a from the constant current control circuit 7 are applied to the threshold voltage generator 36. Then, the threshold voltage Vth for optimizing the energization time of the transistor 5 is generated. The energization signal generator 37 compares the threshold voltage Vth and the triangular wave voltage $V_R$ and generates the ON period signal of the transistor 5 shown in (g) of FIG. 4. The transistor 5 is turned on through the energization controller 6 in response to the rising edge of the ON period signal. Then, a current is supplied to the primary winding 4a of the ignition coil 4 from the power source 11. At this time, the transistor 5 is used in the unsaturation region by the operation of the constant current control circuit 7 and the current flow through the primary winding 4a is maintained constant. Then, the transistor 5 is turned off at the time of the falling edge of the ON period signal in (g) of FIG. 4. When this occurs, a high voltage is induced in the secondary winding 4b of the ignition coil 4 thus firing the spark plug 10. During the time interval from $t_1$ to $t_5$ representing the steady-state condition, the stored voltage $V_P$ has a value corresponding to the peak value of the triangular wave voltage $V_R$ and the threshold voltage Vth is also constant. Thus, the ON period signal for the transistor 5 determined on the basis of these voltages conforms with the desired value.

When the engine is accelerated after the time $t_5$ so that its speed is increased, the period of the pulse signal Ig is decreased and there occurs a difference between the triangular wave voltage $V_R$ and the reference voltage $V_C$ at the time $t_6$. When this occurs, the charge in the voltage storing capacitor 325 included in the voltage storing circuit 32 is discharged rapidly and the reference voltage $V_C$ is decreased until the difference is reduced to zero. At this time, the stored voltage $V_P$ is also decreased along with the decrease in the reference voltage $V_C$. This is accompanied with a decrease in the threshold voltage Vth which is offset with respect to the stored voltage $V_P$ by an amount corresponding to the desired value of the constant current energization time of the power transistor 5. Since the value of the threshold voltage Vth is selected intermediary between the stored voltage $V_P$ and the reference voltage $V_C$, the threshold voltage Vth corrected immediately after the time $t_6$ and the triangular wave voltage $V_R$ become equal to each other at the time $t_7$ and thus the current is supplied to the power transistor 5. As mentioned previously, by suitably selecting the division ratio of the voltage divider 33, it is possible to make the value of the stored voltage $V_P$ just after the rising edge of the pulse signal Ig equal to the peak voltage of the triangular wave voltage $V_R$ at the following falling edge and the stored voltage $V_P$ and the triangular wave voltage $V_R$ coincide at the time $t_8$. Paticulary, when the speed of the engine at the low speed operation is increased rapidly, the period of the ON period is decreased and the ON becomes insufficient thus causing the engine to misfire. In accordance with the invention, however, during the acceleration condition the ON period (the interval from $t_7$ to $t_8$) of the power transistor 5 can always be maintained as desired (constant) as with the ON period during the steady-state condition. As a result, the spark plug 10 can always be fired stably and accurately.

Then, when the engine is decelerated after the time $t_9$, the period of the pulse signal Ig is increased and thus there occures a difference between the triangular wave voltage $V_R$ and the reference voltage $V_C$ at the time $t_{11}$. When this occurs, the voltage storing capacitor 325 included in the voltage storing circuit 32 is rapidly charged by the charging and discharging controller 35 and the stored voltage $V_P$ is increased until the difference voltage is reduced to zero. During the deceleration condition the stored voltage $V_P$ is set to a lower voltage level corresponding to the peak value of the triangular wave voltage $V_R$ before the start of the deceleration and the threshold voltage Vth is corresponding low. Thus, the threshold voltage Vth becomes equal to the triangular wave voltage $V_R$ at the time $t_{10}$ thus generating the ON period signal shown in (g) of FIG. 4. Then, by virtue of the hysteresis provided by the resistors 374 and 375, the ON period signal is not inverted even if the threshold voltage Vth becomes temporarily higher than the triangular wave voltage $V_R$ after the time $t_{11}$ and it stays in the ON state until the time $t_{12}$. Thus, while the ON period from the time $t_{10}$ to the time $t_{12}$ is slightly longer than the desired energization time of the power transistor 5, this is transient in nature and dues not always occur thus giving rise to no problem from the standpoint of the heat generation of the power transistor 5.

Further, in accordance with the invention, by virtue of the fact that the current flow to the transistor 5 is inhibited for the duration of the high level of the energization inhibit signal 31a generated during the discharge period of the triangular wave voltage $V_R$, there is an effect that a high-voltage discharge at the spark plug 10 is not impeded and the spark plug 10 is fired positively.

Figure 5:
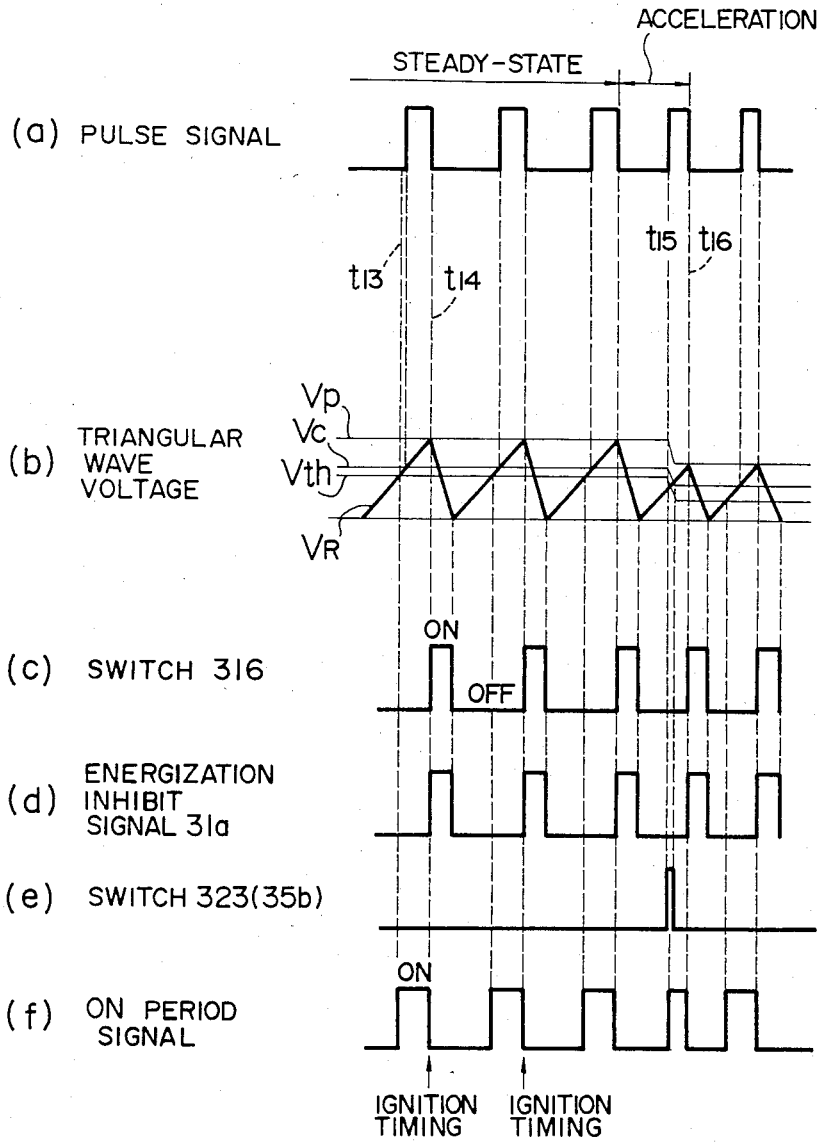
FIG. 5 is a timing chart for explaining the operation of the circuitry of the ignition system of FIG. 1 at high engine speeds.

The timing charg shown in FIG. 5 shows the condition in the high speed range of the engine. In this case, as shown in (b) of FIG. 5, the threshold voltage Vth is set lower than the reference voltage $V_C$. Then, during the steady-state condition, at a time $t_{13}$ the triangular wave voltage $V_R$ and the threshold voltage Vth become equal and the current is supplied to the power transistor 5. Then, the triangular wave voltage $V_R$ and the stored voltage $V_P$ become equal at a time $t_{14}$ and this time $t_{14}$ represents the ignition timing. Thus, the ON period shown in (f) of FIG. 5 is determined.

Then, when the engine comes into the acceleration condition from the steady-state condition, there occurs a difference between the reference voltage $V_C$ and the triangular wave voltage $V_R$ at a time $t_{15}$ (the rising edge of the pulse signal Ig). However, the charge in the voltage storing capacitor 325 included in the voltage storing circuit 32 is discharged rapidly by the charging and discharging controller 35 so that the reference voltage $V_C$ is decreased until the difference is reduced to zero. The stored voltage $V_P$ and the threshold voltage Vth are also decreased along with the decrease in the reference voltage $V_C$. At this time, while the threshold voltage Vth is set lower than the reference voltage $V_C$ so that the threshold voltage Vth and the triangular wave voltage $V_R$ become equal slightly later than during the steady-state condition, the required ON period of the transistor 5 is still ensured. Thus, there is no danger of impeding firing of the spark plug 10, although the ON period of the transistor 5 suffers a slight decrease. As a result, when the engine speed is accelerated during the high speed operation, it is still possible to ensure the required ON period of the transistor 5 and hence it is possible to ensure positive firing of the spark plug 10.

While, in the above-described embodiment, the primary current in the primary winding 4*a* of the ignition coil 4 is subjected to the constant current control by the use of the constant current control circuit 7, there are cases where such constant current control circuit may be eliminated depending on the specification of the ignition coil 4.

Further, while the pulse signal Ig produces a high level so that the leading edge represents its rising edge and the trailing edge synchronized with the ignition timing represents its falling edge, it is possible to arrange so that the pulse signal Ig produces a low level so that the falling edge of the low level represents its leading edge and the rising edge represents its trailing edge.

We claim:

1. An ignition system for an internal combustion engine comprising:

timing signal detecting means responsive to a rotation speed of an engine to generate a pulse signal including a leading edge and a trailing edge corresponding to an ignition timing and having a predetermined duty cycle;

triangular wave generating means for generating a triangular wave voltage synchronized with the trailing edge of said pulse signal;

voltage storing means for storing a voltage level of said triangular wave voltage in synchronism with the leading edge of said pulse signal;

a voltage divider for dividing the stored voltage in said voltage storing means to generate a reference voltage;

comparing means for comparing said reference voltage and said triangular wave voltage to detect a difference therebetween;

charging and discharging control means for correcting the stored voltage in said voltage storing means to reduce said difference at the leading edge of said pulse signal to zero;

threshold voltage generating means for generating a threshold voltage which is offset from said stored voltage by a voltage value corresponding to a desired dwell time of an ignition coil; and energization control means for controlling a dwell time of said ignition coil in accordance with a result of a comparison between said threshold voltage and said triangular wave voltage.

2. An ignition system according to claim 1, wherein said triangular wave generating means comprises:

a capacitor for holding said triangular wave voltage;

a charging current source for charging said capacitor;

a discharging current source for discharging said capacitor; and a switch for alternately connecting said charging and discharging current sources to said capacitor.

3. An ignition system according to claim 2, wherein a ratio of currents in said current sources is preset to a predetermined value, and that the slopes of discharging and charging characteristics of said triangular wave voltage are constant.

4. An ignition system according to claim 2, wherein said switch connects said capacitor to said discharging current source in response to the trailing edge of said pulse signal and connects said capacitor to said charging current source when said capacitor is discharged to a zero potential.

5. An ignition system according to claim 1, wherein said triangular wave generating means generates during a discharging period following the trailing edge of said pulse signal an energization inhibit signal for interrupting the flow of current to said ignition coil.

6. An ignition system according to claim 1, wherein said voltage storing means comprises:

a capacitor for holding said stored voltage;

a charging power source for charging said capacitor; and a discharging power source for rapidly discharging said capacitor.

7. An ignition system according to claim 6, wherein first normally-open contact means is connected between said charging power source and said capacitor, wherein second normally-open contact means is connected between said discharging power source and said capacitor, and wherein output terminals of said charging and discharging control means are connected to said first and second normally-open contact means, respectively.

8. An ignition system according to claim 7, wherein at the time of the leading edge of said pulse signal, said second normally-open contact means is closed when said reference voltage is higher than said triangular wave voltage and said first normally-open contact means is closed when said reference voltage is lower than said triangular wave voltage whereby said reference voltage and said triangular wave voltage attain the same value.

9. An ignition system according to claim 1, further comprising a constant current control circuit for detecting the current flow in said ignition coil to apply a control signal to said energization control means and thereby to limit the current flow in said ignition coil to a predetermined value.

10. An ignition system according to claim 9, wherein said threshold voltage generating means is responsive to a feedback information supplied from said constant current control circuit and a supply voltage to offset said stored voltage and thereby to generate a threshold voltage.

11. An ignition system according to claim 1, further comprising energization signal generating means connected before said energization control means so as to receive said triangular wave voltage and said threshold voltage and compare the same thereby generating an energization signal.

12. An ignition system according to claim 11, wherein said energization signal generating means comprises comparing means for comparing said triangular wave voltage and said threshold voltage, and wherein said comparing means has a hysteresis characteristic.

* * * * *